United States Patent [19]

Hemmer

[11] 4,280,749

[45] Jul. 28, 1981

[54] SOCKET AND PIN CONTACTS FOR COAXIAL CABLE

[75] Inventor: Valentine J. Hemmer, Sidney, N.Y.

[73] Assignee: The Bendix Corporation, Southfield, Mich.

[21] Appl. No.: 88,429

[22] Filed: Oct. 25, 1979

[51] Int. Cl.[3] ..... H01R 17/06

[52] U.S. Cl. ..... 339/177 R; 174/89

[58] Field of Search ..... 339/177 R, 177 E, 258 R, 339/258 P; 174/89

[56] References Cited

U.S. PATENT DOCUMENTS

| | | | |
|---|---|---|---|
| 2,694,183 | 11/1954 | Elden | 339/177 R |
| 3,103,548 | 9/1963 | Concelman | 339/177 R |
| 3,209,287 | 9/1965 | Oxner | 333/34 |
| 3,373,243 | 3/1968 | Janowiak | 174/89 |
| 3,609,651 | 9/1971 | Sladek et al. | 339/177 E |
| 3,879,102 | 4/1975 | Horak | 339/177 R |
| 4,046,451 | 9/1977 | Juds et al. | 339/177 R |

FOREIGN PATENT DOCUMENTS

| | | | |
|---|---|---|---|
| 885093 | 11/1971 | Canada | 339/177 R |
| 61816 | 5/1968 | German Democratic Rep. | 339/258 R |
| 920725 | 3/1963 | United Kingdom | 339/177 R |

*Primary Examiner*—Neil Abrams
*Attorney, Agent, or Firm*—Richard V. Westerhoff; Raymond J. Eifler; Charles D. Lacina

[57] ABSTRACT

An electrical contact for a coaxial cable (3) includes a tubular shell (17, 35) forming an outer contact element (19, 37) and an inner socket (13) or pin (31) type contact element having a pair of laterally spaced resilient fingers (49, 63) housed in a tubular insulator (15, 33). As the tubular insulator (15, 33) is inserted into the tubular shell (17, 35), wedge blocks (85, 107) extending laterally through slots (95, 113) in the walls of the insulator, compress the resilient fingers of the contact element against the center conductor of the cable. The cable shielding (7) is splayed back over a resilient sleeve (115) at one end of a bushing (21) which slides onto the end of the cable. This sleeve is split longitudinally and is resilient such that it may be compressed radially to insert it into the tubular shell (17, 35) where it expands to press the splayed back cable shielding into contact with the tubular shell. The bushing (21) includes a second sleeve (117) split longitudinally into two halves (130, 131), each of which is joined to the first sleeve (115) in axial alignment therewith by a web (119). Outward projections (135) on each half of the resilient second bushing sleeve snap into holes (139, 141) in the tubular shell (17, 35) to lock the contact together as a unit. The insulators (15, 33) are split longitudinally into two identical halves (a and b) which are molded integrally with the wedge blocks (85, 107) and snapped together to form the housing for the inner contact (13, 31).

12 Claims, 16 Drawing Figures

SOCKET AND PIN CONTACTS FOR COAXIAL CABLE

BACKGROUND OF THE INVENTION

1. Field of the Invention

This invention relates to electrical contacts for coaxial cable and more particularly to socket and pin type coaxial cable contacts which do not require crimping, soldering or welding to connect the shielding and the solid or stranded center conductor of the coaxial cable to the contact.

2. Prior Art

The typical coaxial cable has a stranded or solid center conductor surrounded by a woven shielding sleeve with insulation between the conductor and the sleeve and additional insulation over the shielding. When socket and pin type electrical contacts are used with such cables, the center conductor is connected to a pin or socket type center contact and the shielding is connected to an outer contact which takes the form of a tubular metallic shell. Generally, the conductor and the shielding are connected to the respective inner and outer contacts by a crimped or soldered connection to assure good electrical contact and a mechanical connection that will not pull apart. However, these crimped or soldered connections make it more difficult to replace contacts or to disconnect and reconnect contacts that are not properly installed in the first instance.

It is a primary object of the present invention to provide socket and pin type contacts for coaxial cables that do not require crimping, soldering, welding or other special tools to provide a good electrical and mechanical connection.

It is another object of the invention to provide electrical contacts of the type described in the first object which can be easily and quickly removed and replaced.

It is also an object of the invention to provide such contacts which can be used with a coaxial cable having either a solid or stranded center conductor.

It is yet another object of the invention to provide such contacts which can be easily and economically produced.

SUMMARY OF THE INVENTION

According to the invention, an electrical contact (1, 29) for a coaxial cable (3) includes an outer contact (19, 37) with a tubular shell (17, 35), a center contact (13, 31) for connecting to the center conductor (5) of the cable (3), an insulator (15, 33) for supporting the center conductor (5) within the tubular shell (17, 35) and a bushing (21) for electrically connecting the cable shielding (7) to the tubular shell (17, 35) and for mechanically securing the contact (1, 29) to the cable (3), all without requiring crimping, soldering, welding or special tools of any sort.

The center contact (13, 31) comprises a contact element having a mating portion, either a socket (44) or a pin (57), at one end, and extending from the other end a pair of resilient, laterally spaced fingers (49, 63) which may be laterally compressed to mechanically and electrically engage the center conductor (5) of a coaxial cable (3). These fingers may be bent back on themselves with undulations in the reversely bent portions (51) to provide better contact with the conductor.

The insulator (15, 33) has a tubular housing (65, 97) which supports the resilient fingers of the center contact (13, 31) in an interior cavity (93, 111). The housing (65, 97) is provided with diametrically opposite transverse slots (95, 113) extending through the walls thereof into the interior cavity (93, 111). A pair of wedge blocks (85, 107) are movable in these slots (95, 113) and bear against the resilient fingers (49, 63) to urge them toward each other to grip the cable center conductor (5) as the insulator (15, 33) slides into the tubular shell (17, 35) of the outer contact (19, 37). The insulator (15, 33) is preferably split longitudinally into mirror image molded halves (a and b) with a wedge block (85, 107) integrally connected to each half by a flexible web (87, 109). In this manner only two identical molded parts are needed for the insulator.

The bushing (21) includes a tubular body that slides over the end of the cable (3) with the woven shielding (7) splayed back over one end. This end of the tubular body is provided with a longitudinal slot (129) which allows it to be compressed as the bushing (21) is inserted in the end of the tubular shell (17, 35) of the outer contact and to expand when in place to mechanically press the splayed back shielding (7) into contact with the tubular shell (17, 35). The other end of the bushing (21) mechanically locks the bushing into the tubular shell (17, 35) of the outer contact.

Preferably, the bushing (21) is in the form of two resilient sleeves (115, 117) joined in axial alignment by a web (119). The first sleeve (115), in addition to being split longitudinally, is provided with an uneven outer surface such as a grooved (127) or a knurled surface to form a better gripping surface for the splayed back cable shielding (7). In addition, projections (125) are provided on the inner wall of this sleeve to grip the cable (3) and preclude its being pulled out of the bushing (21). The second bushing sleeve (117) is split longitudinally into two halves (130, 131), each of which is joined to the first sleeve (115) by a web (119). Radial, outwardly directed, beveled projections (135) at each diametric edge (137) of the second sleeve halves (130, 131) are received in holes (139, 141) in the tubular shell (17, 35) to lock the bushing (21) in the tubular shell (17, 35). The resilient halves (130, 131) of the second sleeve (117) are compressible radially for engaging and disengaging the locking projections (135) on the bushing (21) with the holes (139, 141) in the tubular shell (17, 35) of the outer contact (19, 37). The bushing (21) in turn urges the insulator (15, 33) supporting the center contact (13, 31) against internal shoulders (143, 145) in the shell, or in the case of the pin type contact, against the end of an outer contact sleeve (39) to complete the assembly.

Accordingly, the center conductor (5) of the coaxial cable (3) is gripped by the resilient fingers (49, 63) of the center contact (13, 31) and the shielding (7) is pressed against the tubular shell (17, 35) of the outer contact (19, 37) so that no crimping, soldering or welding is required. The fold in the shielding (7) over the bushing (21), the pressure between the resilient split bushing sleeve (115) and the shell (17, 35), the roughened outer surface (127) of the sleeve (115) over which the shielding (7) is folded, and the internal projections (125) in the bushing (21) which dig into the insulating jacket (11) on the coaxial cable (3), assure a good mechanical connection that can not easily be pulled out. Since no longitudinal force is required to insert the center conductor (5) into the inner contacts (13, 31) which close on the conductor (5) by lateral forces, the subject electrical contacts (1, 29) can be used with coaxial cables (3) having stranded center conductors as well as those in which the center conductor is solid.

The inner (13, 31) and outer (19, 37) contacts of the invention can be stamped and rolled from sheet material and the insulators (15, 33) and bushing (21) are designed for being easily molded. Thus the contacts (1, 29) can be easily and economically manufactured.

DESCRIPTION OF THE PREFERRED EMBODIMENTS

Figure 1:
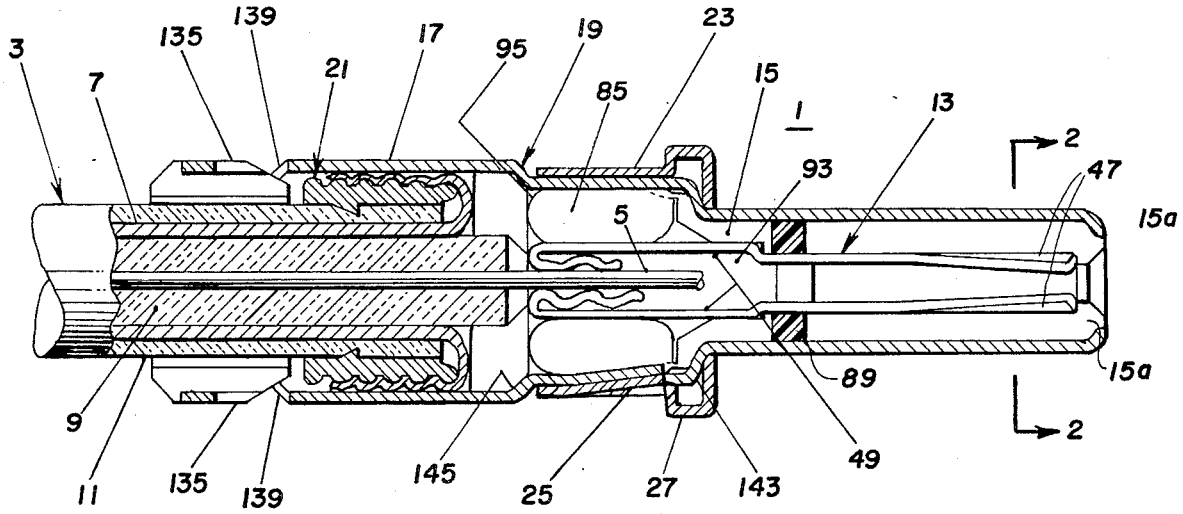
FIG. 1 is a longitudinal sectional view through a coaxial cable contact having an outer pin contact housing with an inner socket contact made in accordance with the principles of the invention.
Figure 2:
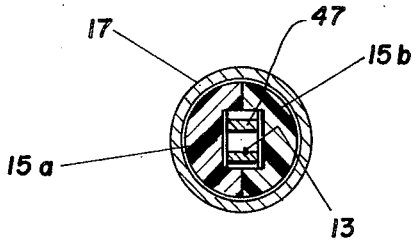
FIG. 2 is a sectional view through the contact of FIG. 1 taken along the line 2—2.

FIG. 1 illustrates an electrical contact 1 connected to the end of a coaxial cable 3 having a stranded or solid center conductor 5 surrounded by a woven wire shielding sleeve 7 with insulation 9 between the conductor 5 and the sleeve 7 and with an insulating jacket 11 covering the shielding 7. The contact 1 includes an inner socket contact 13 which engages the inner conductor 5 of the coaxial cable and is housed in an insulator 15 which in turn is received in the tubular shell 17 forming an outer pin type contact 19. As shown in FIG. 2, the insulator 15 is constructed of two identical molded halves 15*a* and 15*b* as described more fully below. A bushing 21 slides over the end of the coaxial cable 3 and is locked into the end of the tubular shell 17 in a manner also to be discussed below. This bushing wedges the shielding sleeve 7 of the coaxial cable, which is splayed back over the inner end of the bushing, against the tubular shell 17 to make electrical contact therewith. A sleeve 23 which is lanced as at 25 to the tubular shell 17 in the vicinity of its midpoint is provided with an annular projection 27 which is used to retain the contact in a connector in a manner well understood by those skilled in the art.

Figure 3:
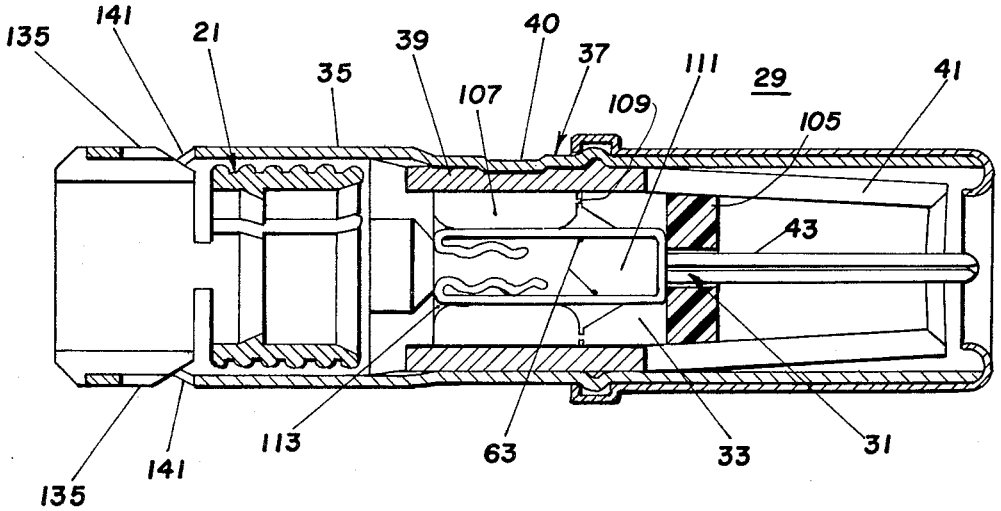
FIG. 3 is a longitudinal sectional view through a coaxial cable contact having an outer socket contact housing and an inner pin contact made in accordance with the principles of the invention.

FIG. 3 illustrates a contact designed for mating with the contact of FIG. 1. An inner pin contact 31 is housed in a two part tubular insulator 33 which is received in the tubular shell 35 of an outer socket contact 37. The outer contact also includes an electrically conductive sleeve 39 between the insulator 33 and shell 35 which has a pair of elongated fingers 41 concentric with the pin 43 of the inner contact 31. The fingers 41 engage the shell 17 of the contact 1 to complete a circuit between the shielding sleeves of the two sections of coaxial cable connected to contacts 1 and 29 when the pin 43 of contact 29 is inserted into the socket 13 of contact 1 to complete a circuit between the center conductors of the cables. The sleeve 39 is retained in place inside the shell 35 and in electrical contact therewith by a crimp 40.

Figure 4:
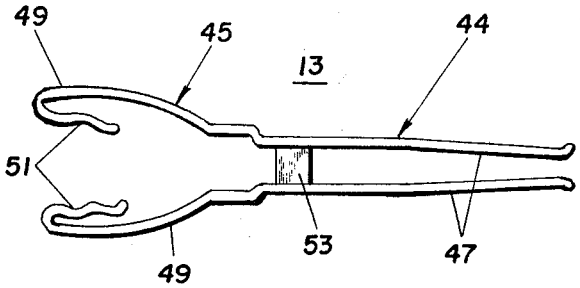
FIG. 4 is a side elevation view of the inner contact of the socket type contact of FIG. 1 shown in expanded condition.
Figure 5:
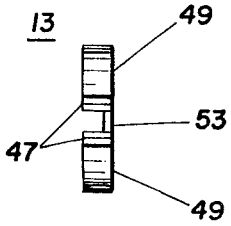
FIG. 5 is an end view of the inner contact of FIG. 4.

As shown in FIGS. 4 and 5, the inner contact 13 of contact 1 comprises a mating portion 44 at one end and a wire receiving portion 45 at the other end. The mating portion has a pair of resilient longitudinal fingers 47 forming a socket while the wire receiving portion includes a pair of laterally spaced resilient fingers 49 extending in the opposite direction. The ends of the fingers 49 are bent inward and back upon themselves as at 51 with the reversely bent portions having undulations for better contact with the center conductor of the coaxial cable. The inner contact 13 can be stamped and formed from a sheet of resilient, electrically conductive material such as a beryllium copper alloy with each finger 49 of the wire receiving portion an extension of one of the fingers 47 of the mating portion and with the two halves of the contact joined by a web 53.

Figure 6:
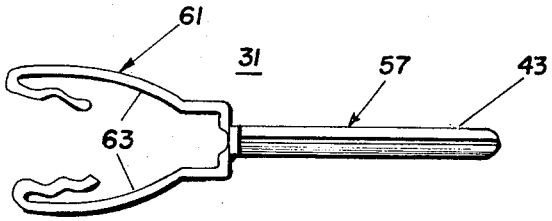
FIG. 6 is a side elevation view of the inner contact of the pin type contact of FIG. 3 shown in expanded condition.

FIG. 6 illustrates in detail the inner contact 31 for the contact 29 of FIG. 3. This inner contact has a mating portion 57 in the form of a chamfered pin 43 and a wire receiving portion 61 having laterally spaced resilient fingers 63 similar in configuration to those of inner contact 13. Like inner contact 13, contact 31 can be stamped and formed from a sheet of a beryllium copper alloy with the forward portion rolled into the pin 43.

Figure 8:
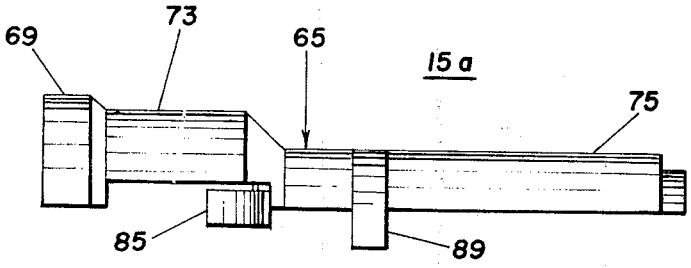
FIG. 8 is a top plan view of the insulator half shown in FIG. 7.
Figure 7:
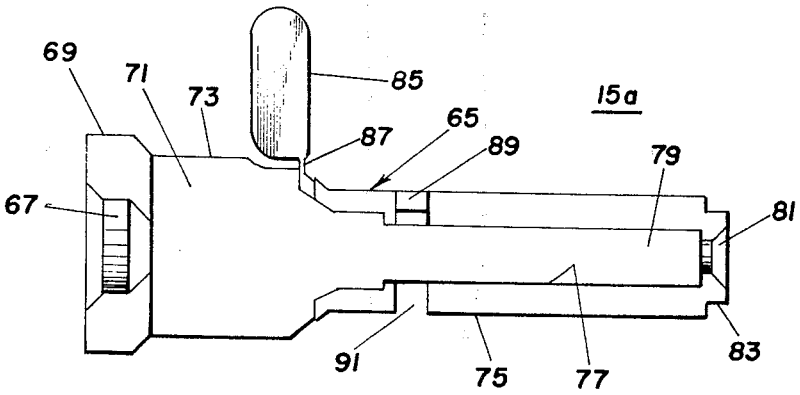
FIG. 7 is a side elevation view of one-half of the insulator used in the pin type contact of FIG. 1 shown in the form in which it is molded.
Figure 9:
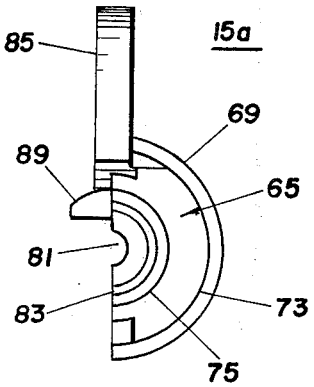
FIG. 9 is an end elevation view taken from the right end of the insulator of FIG. 7.

FIGS. 7, 8 and 9 illustrate the details of one-half 15*a* of the insulator 15 used in the contact 1. Each insulator half 15*a* comprises one-half 65 of a cylindrical housing split along the longitudinal axis. A beveled bore 67 through a shoulder 69 on one end of the housing 65 is tangent to a flat surface 71 that extends laterally through the body 73 of the housing 65. The housing 65 tapers downward from the body portion 73 to an elongated section 75 having a longitudinal groove 77 therein with a flat bottom surface 79 which is coplanar with the surface 71. A beveled bore 81 in a shoulder 83 on the free end of the elongated section 75 is tangent to the surface 79. A wedge block 85 is formed integrally with the housing 65 and is joined thereto by a flexible web 87. An arcuate projection 89 extends laterally from the elongated section 75 of the housing 65 and immediately below this projection is a complementary recess 91. Two identical halves 15*a* and 15*b* are assembled with the projection 89 on each half extending into the recess 91 on the other half and with an integral wedging block extending laterally from each side of the assembly. With the two halves pressed together, an inner cavity 93 (see FIG. 1) is formed within the housing between the inner surfaces 71 and 79 on each half. The inner contact 13 is inserted in this cavity as the insulator is assembled. Mating of the two insulator halves 15*a* and 15*b* also forms slots 95 (also see FIG. 1) extending transversely through the walls of the insulator into the inner cavity 93. The wedge blocks 85 are slidable in these slots 95 to bear against the fingers 45 of the contact 13 and compress them about the inner conductor 5 of the coaxial cable as shown in FIG. 1.

Figure 11:
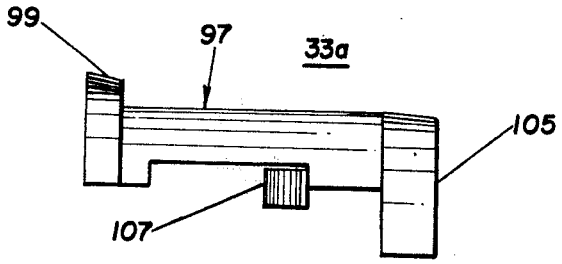
FIG. 11 is a top plan view of the insulator half of FIG. 10.
Figure 10:
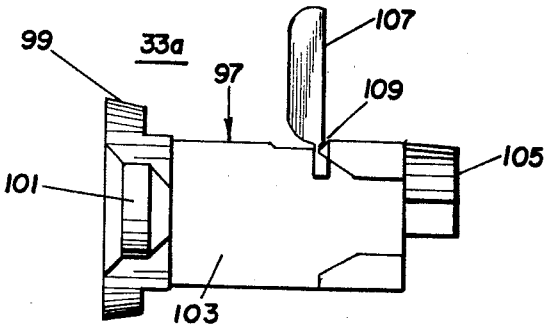
FIG. 10 is a side elevation view of one-half of the insulator used in the socket type contact of FIG. 3 shown in the form in which it is molded.
Figure 12:
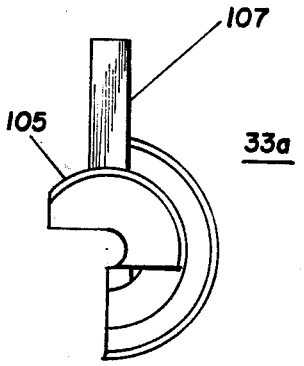
FIG. 12 is an end elevation view taken from the right end of the insulator of FIG. 10.
Figure 13:
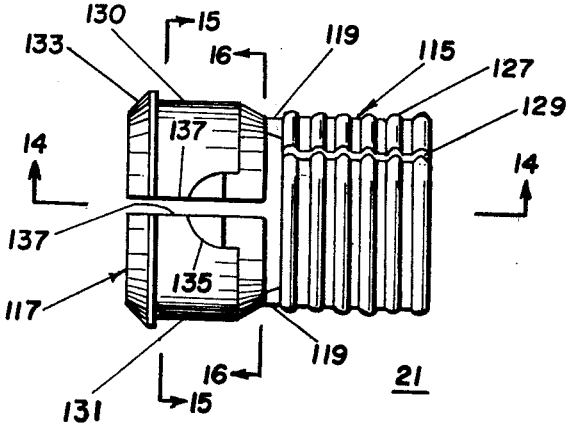
FIG. 13 is a side view of a bushing used in the contacts of FIGS. 1 and 3.
Figure 15:
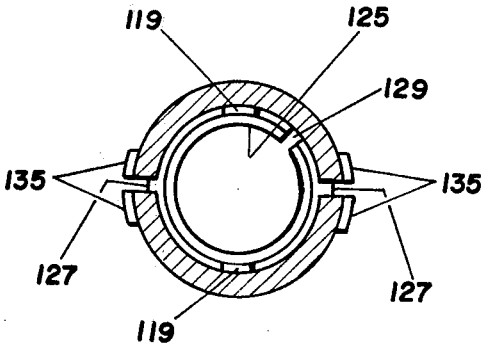
FIG. 15 is a transverse sectional view taken along the line 15—15 in FIG. 13.
Figure 14:
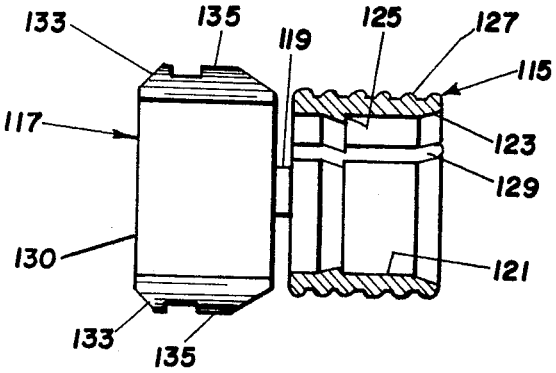
FIG. 14 is a longitudinal sectional view taken along the line 14—14 in FIG. 13.
Figure 16:
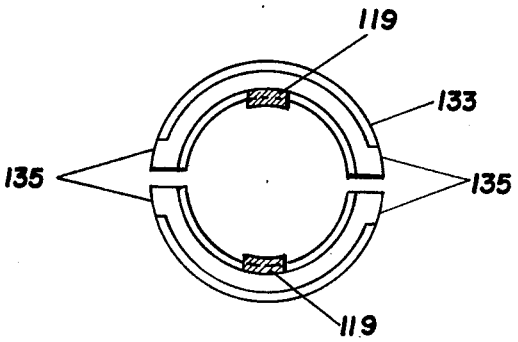
FIG. 16 is a transverse sectional view taken along the line 16—16 in FIG. 13.

FIGS. 10, 11 and 12 illustrate a molded half 33*a* of the insulator 33 used in the contact 29 of FIG. 3. This insulator half differs from the insulator half 15*a* used with the socket contact in not having an elongated section comparable to the section 75. Otherwise, the insulator half 33*a* is similar to insulator half 15*a*, having a half cylindrical housing 97, a shoulder 99 with a beveled bore 101 which is tangent to a planar surface 103, a lateral projection 105 for mating the two halves of the insulator and a wedge block 107 integrally joined to the housing 97 by a flexible web 109. Identical halves 33*a* and 33*b*, when joined together, form an inner cavity 111 housing the resilient fingers 63 of the pin type contact 31 and transverse slots 113 through which the wedge blocks 107 urge the resilient fingers 63 of the inner contact 31 against the center conductor of a coaxial cable (see FIG. 3).

FIGS. 13 through 16 illustrate the details of the bushing 21 which comprises sleeves 115 and 117 joined in axial alignment by a pair of webs 119. The inner wall 121 of the sleeve 115 flares outward at the free end as at 123 and is provided with a projection 125 which extends radially inward and axially toward the free end. The projection 125, which may take the form of an annular shoulder as shown, or angularly spaced discrete teeth, digs into the insulating jacket 11 of the coaxial cable to assist in reducing the likelihood of the cable being pulled out of the assembled contact. The outer surface of the sleeve 115 is provided with annular grooves 127 as shown or is knurled or otherwise roughened to provide a better gripping surface for the coaxial cable shielding 7 which is splayed back over the exterior of sleeve 115. In addition, the sleeve 115, which is molded integrally with sleeve 117 of a resilient material, is provided with a longitudinal slot 129 so that it functions as a C spring which may be compressed radially.

The sleeve 117 is split longitudinally into two halves 130 and 131, each joined to the sleeve 115 by a web 119. The free end of each half sleeve is provided with a beveled shoulder 133 while beveled, radially outwardly directed projections 135 are provided on the other end of each sleeve half adjacent each longitudinal edge 137. The bushing 21 is used with both the socket type contact 1 and the pin type contact 29 with the projections 135 snapping into and engaging holes 139 and 141 in the tubular shells 17 and 35 respectively (see FIGS. 1 and 3). Since the bushing 21 is not required to carry an electric current, it can be molded from either an insulating or conductive material.

The subject coaxial cable contacts are used in the following manner. The housing 21 is slid over the end of the coaxial cable 3 and the woven shielding 7 is splayed back over the grooved outer surface 127 of the sleeve 115. In the case of the socket type contact 1, the stripped center conductor 5 of the cable is inserted through the bore 67 in the insulator 15 into the space between the undulated, bent back portions 51 of the fingers 49 of the inner contact 13. Since the contact fingers are open at this stage, no longitudinal force is required to insert the center conductor and therefore the contact is usable with stranded as well as solid center conductor cable.

The insulator 15 is then inserted into the tubular shell 17 until it seats against the shoulders 143 and 145. As the insulator is inserted, the inner walls of the tubular shell 17 bear against the wedge blocks 85 which in turn compress the resilient fingers 49 of the inner contact 13 against the inner cable conductor 5. As the wedge blocks 85 enter the narrower section of the tubular shell between the shoulders 143 and 145, the fingers of the contact 13 are further compressed to firmly grip the conductor 5.

As the bushing 21 enters the end of the tubular shell 17, the C shaped sleeve 115 is compressed radially. With the sleeve 115 inside the tubular shell, it expands to press the shielding 7 into electrical contact with the tubular shell. As the second sleeve 117 of the bushing 21 enters the end of the tubular shell 17, the beveled projections 135 compress the halves 130 and 131 of the sleeve until the projections 135 are aligned with the holes 139 in the tubular shell 17, whereupon they snap into the holes to lock the contact together as a unit. The contact 29 is secured to the end of a coaxial cable in a similar manner which will be understood by those skilled in the art from the above discussion. Since no soldering, welding or crimping is required to make the connections, the contacts can be removed and replaced quickly and with little difficulty. In mating the contact 29 of FIG. 3 with the contact of FIG. 1, the pin 43 of contact 29 slides between and is engaged by the fingers 47 of the contact 1 to complete an electrical circuit for the center conductor of the two lengths of cable, while the reduced diameter end of shell 17 of contact 1 slides between and is engaged by the fingers 41 of the sleeve 39 which is in electric contact with the shell 35 to complete an electrical circuit for the shielding on the two cables.

While specific embodiments of the invention have been described in detail, it will be appreciated by those skilled in the art that various modifications and alternatives to the details disclosed herein could be developed which would still fall fully within the broad principles established by the invention. Accordingly, the particular arrangements disclosed are meant to be illustrative only and not as limiting on the scope of the invention which is to be given the full breadth of the appended claims and any and all equivalents thereof.

What is claimed is:

1. An electrical contact for a coaxial cable having a center conductor surrounded by a sleeve of shielding material with insulation between the conductor and the shield and around the shield, said contact comprising:

an outer contact including an electrically conductive tubular shell, said shell including first and second ends;

a center contact having means for gripping and making electrical contact with the center conductor of the coaxial cable;

an insulator supporting said center contact within said outer contact with said center contact accessible from the first one of said tubular shell; and a bushing comprising a tubular body and radially compressible locking means for engaging and disengaging said tubular body within the second end of said tubular shell, said tubular body comprising a first sleeve which constitutes the first end of the tubular body, a second sleeve and a flexible web joining the two sleeves in axial alignment, said locking means being affixed to said second sleeve, said tubular body being first slipped over the end of the coaxial cable with the shielding sleeve of the cable splayed back over the first end of the tubular body and the tubular body then being inserted, said first end first, and locked by the locking means into the second end of the tubular shell with the splayed back shielding sleeve in electrical contact with the interior wall of said tubular shell, said locking means on the second sleeve not engaging the shield of the cable.

2. The electrical contact of claim 1 wherein said bushing is resilient, said one end of the tubular body is provided with a longitudinal slot extending through the wall thereof and the outer diameter of said one end is proportioned such that said one end is compressed radially to insert it within the tubular shell where it expands radially to mechanically press the splayed back portion of the cable shielding sleeve into engagement with said tubular shell.

3. The electrical contact of claim 2 wherein said one end of the tubular body is grooved on its outer surface.

4. The electrical contact of claim 2 wherein said second sleeve is split longitudinally into two spaced apart halves each connected to said first sleeve by a web and wherein said locking means comprise radial projections on the outer surface of each half of said second sleeve which engage recesses in the inner wall of said tubular shell.

5. The electrical contact of claim 1 wherein:

said center contact comprises an electrically conductive contact element having a mating portion at one end and a wire receiving portion at the other end, said wire receiving portion comprising a pair of laterally spaced resilient fingers which extend longitudinally rearward from the mating portion and are compressible laterally to mechanically and electrically engage and hold the center conductor of a coaxial cable which is inserted longitudinally between said fingers;

said insulator comprises a cylindrical housing having an interior cavity housing the wire receiving portion of said contact element and having portions which urge said resilient fingers of the contact element towards each other to engage the center conductor of the coaxial cable as the cylindrical housing is inserted into said tubular shell; and the portion of said cylindrical housing which urges said resilient fingers of the contact element toward each other comprises a pair of wedges movable in diametrically opposed transverse slots extending through the walls of said cylindrical housing into the interior cavity thereof.

6. A bushing for securing a coaxial cable in the end of a tubular electrical contact comprising:

first and second resilient sleeves joined in axial alignment by a flexible web, said sleeves being slidable over the end of a coaxial cable with the cable shielding splayed back over said first sleeve, said first sleeve having a longitudinal slot extending through the wall thereof such that said first resilient sleeve functions as a C spring which is compressed radially to insert said sleeve in the tubular electrical contact and then expands to press the splayed back shielding into electrical contact with the inner wall of the tubular electrical contact and to mechanically secure the cable in the contact, said second sleeve having locking means which engage and lock the bushing to the tubular contact.

7. The bushing of claim 6 including a projection extending radially inward from the inner wall of said first sleeve and axially toward the free end of said first sleeve to engage the coaxial cable and preclude its being pulled out of the contact and bushing.

8. The bushing of claim 7 wherein said second sleeve is split longitudinally into spaced apart halves each joined to said first sleeve by a web, and wherein said locking means include radially outwardly directed projections adjacent each edge of each resilient second sleeve half which engage holes in the walls of the tubular contact to lock the bushing in the contact, said second sleeve halves being compressible to permit said projections to slide inside the tubular contact into alignment with the holes in the walls thereof.

9. The electrical contact of claim 6, 7 or 8 wherein said first sleeve is provided with an irregular outer surface.

10. An inner contact assembly for an electrical contact having a tubular outer contact, said inner contact comprising:

a contact element including a mating portion and a wire receiving portion, said wire receiving portion including a pair of laterally spaced, electrically conductive, resilient fingers extending longitudinally from the mating portion of the contact element which can be deflected laterally toward each other to mechanically and electrically engage a wire inserted longitudinally between said fingers, the end of said laterally spaced resilient fingers being bent inwardly toward each other and then backwardly upon themselves with at least one of the reversely bent portions having undulations therein; and a cylindrical insulator for electrically insulating and supporting said contact element concentrically within and from the tubular outer contact, said insulator comprising a tubular housing having an interior cavity for housing said wire receiving portion of the contact element and wedge members movable within diametrically opposite slots extending through the walls of the tubular housing into the interior cavity, said insulator being insertable into the tubular outer contact where the wedge members bear against interior walls of the tubular outer contact and urge the resilient fingers of the contact element toward each other to mechanically and electrically engage a wire inserted therebetween.

11. The contact assembly of claim 10 wherein said cylindrical insulator is split longitudinally into two mirror image parts, each having a projection extending transversely towards the other part to aid in alignment of said two parts, and wherein the surfaces along which the insulator is split are provided with channels which, when the two parts of the insulator are mated, form said interior cavity and said slots.

12. The contact assembly of claim 11 wherein one of said wedge members is formed integrally with each half of said insulator and is joined thereto by a flexible web.

* * * * *